United States Patent [19]

Appleman

[11] 4,161,555

[45] Jul. 17, 1979

[54] FLAME SPRAYING PROCESS FOR MATERIALS REQUIRING FUSION

[75] Inventor: Theodore C. Appleman, Mansfield, Ohio

[73] Assignee: Eastside Machine & Welding, Inc., Ashland, Ohio

[21] Appl. No.: 893,875

[22] Filed: Apr. 6, 1978

[51] Int. Cl.[2] ..... B05D 1/08

[52] U.S. Cl. ..... 427/333; 427/223; 427/224; 427/225; 427/344; 427/376 B; 427/376 C; 427/423; 427/444; 428/937

[58] Field of Search ..... 428/937; 427/223, 224, 427/225, 226, 300, 309, 333, 344, 376 C, 376 B, 376 H, 405, 423, 445, 156

[56] References Cited

U.S. PATENT DOCUMENTS

| | | | |
|---|---|---|---|
| 1,080,059 | 12/1913 | Hatfield et al. | 427/156 |
| 2,936,229 | 5/1960 | Shepard | 75/170 X |
| 2,961,335 | 11/1960 | Shepard | 427/423 X |
| 3,111,267 | 11/1963 | Shepard et al. | 239/85 |
| 3,122,321 | 2/1964 | Wilson et al. | 239/84 |
| 3,136,484 | 6/1964 | Dittrich | 239/295 X |
| 3,266,727 | 8/1966 | Shepard et al. | 239/85 |
| 3,340,084 | 9/1967 | Eisenlohr | 427/423 X |
| 3,607,343 | 9/1971 | Longo | 427/423 X |
| 4,045,593 | 8/1977 | Hill et al. | 427/344 X |

*Primary Examiner*—Shrive P. Beck
*Attorney, Agent, or Firm*—Mack D. Cook, II

[57] ABSTRACT

An improvement for the flame spray process in which a heat-fusible self-fluxing material is heated in a heating zone to at least heat-softened condition and propelled in such condition out of said zone in finely divided form onto an obscure substrate surface of a base article. An obscure substrate surface may be such that conventional fusing techniques are not suitable for use in final bonding of the flame spray material to the substrate. The invention includes the use of an ordinary commercial soluble silicate solution applied to the coated substrate surface, solidified by furnace fusing, and removed by attrition to provide a base article which may be further processed to predetermined dimensional tolerances.

4 Claims, No Drawings

FLAME SPRAYING PROCESS FOR MATERIALS REQUIRING FUSION

BACKGROUND OF THE INVENTION

The invention relates "to the industrial technique of flame spraying, formerly known as metallizing. Flame spraying is a process for applying a metal, a ceramic (metal oxide), or a mixed metal/ceramic (cermet) coating in a molten state to another metal surface (also called substrate) to form a bond between the two that will permit the coated surface (or object) to undergo further finishing operations, resist corrosion, or withstand high temperatures or other wear and stress during use. The coating to be sprayed on the substrate is commonly referred to as 'flame spray material.' The flame spray material, which may be in rod, wire or powder form, is fed into a device called a 'flame spray gun.' As the flame spray material passes through the gun it is reduced by gas-oxygen or electric arc flame to a molten or semi-molten state and propelled in atomized form onto the surface to be coated, such as paint is sprayed." Neaher, District Judge, Eutectic Corp. v. Metco Corp., 418 F.Supp. 1186, 1188, 191 USPQ 505, 507 (E.D.N.Y. 1976).

There exists in the flame spraying art a broad class or category of flame spray materials known as "self-fluxing," generally made so by the presence of small amounts of silicon and boron. The self-fluxing flame spray materials, often referred to as "self-fluxing alloys," are commonly based on nickel-chromium and have a high expansion coefficient (approximately 8 to $9\times10^{-6}$/°F.). A self-fluxing alloy coating, applied by a flame spray gun to a substrate surface, properly prepared and heated to 200° F. or higher, tends to contract during application; but the coating-substrate bond will be sufficiently strong to retain the coating until the next and critical operation referred to as "fusing."

Fusing in the flame spraying art requires the application of heat energy from an external source to the coated substrate surface so as to cause the coating to penetrate the surface and fuse or alloy therewith. In flame spraying literature, reference may be found to "wetting," a term of art denoting the ability of melted material to penetrate a metallic surface during application by a flame spray gun. When flame spraying a self-fluxing alloy, the wetting properties are sufficient or adequate to form a "retaining bond" but not sufficient or inadequate to form a "permanent bond." A permanent bond is essential when the base article and the coated substrate surface is intended to be further processed to predetermined dimensional tolerances, as by machining, grinding, polishing or honing.

A very widely used fusing technique is referred to as "torch fusing." The torch is a conventional gas welding instrument using appropriate oxygen-acetylene mixtures and ratios. The operator or technician is cautioned to always use a "soft" flame since a high velocity flame will cause the molten coating to flow unevenly. The work piece is evenly preheated to a temperature of from 600° F. to 1000° F. from a distance of 4 or 5 inches, moving the flame slowly back and forth. After the work piece is preheated, the torch nozzle is brought up to within 1½" of the work piece starting about 1" inside the end or edge of the sprayed area. If the work piece is rotating, the nozzle may be held stationary until the coating comes up to the fusing temperature. If the work piece is stationary, the flame should be gently oscillated as the melting temperature is approached. The skilled operator will avoid localized overheating which will cause the coating to run, sag or diffuse. The skilled operator, with practice, will also be able to recognize the fusion point from visible characteristics such as a "shine" when the coating fuses.

Another fusing technique is "furnace fusing" performed in a controlled atmosphere. It is essential to avoid an oxidizing atmosphere which is deleterious to the coating during heating. Furnace temperatures of 1900° F. to 1950° F. may be used if furnace atmosphere is high in hydrogen and carbon monoxide. However, since the work piece should come up to fusing temperature as quickly as possible, actual temperature should be higher when the coated base article is put in the furnace. Excessive time at fusing temperature or inclination or non-horizontal orientation of the substrate surface within the furnace will each contribute to run, sag or diffusion of the coating.

The invention was conceived to improve the industrial technique of flame spraying after the coating has been applied to the substrate surface. The invention is used to improve the fusion of the coating to the substrate surface. The invention may be used to eliminate the technique of torch fusing. The invention may be used to improve the technique of furnace fusing.

The invention is intended for use after a flame spray coating has been applied to an "obscure" substrate surface. An obscure substrate surface may be of such a dimensional character, or have a location relative to other dimensional features of the base article, such that even a skilled operator will not have working room or space to use his gas torch in a proper or efficient manner. An obscure substrate surface can still (and must) receive a flame spray coating. Various modifications as to nozzle lengths, directional tips, etc., permit the flame spray gun to effectively reach even the obscure substrate surface. Nevertheless, the substrate surface is obscure in the meaning or sense of being relatively unexposed, inaccessible to, hidden from, or merely "hard to get at" insofar as a conventional torch fusing technique is concerned.

With reference to a conventional furnace fusing technique, the invention permits the use of a normal atmosphere furnace. There is no requirement that the furnace atmosphere be non-oxidizing. The substrate surface intended for fusing in a furnace may also be regarded as "obscure" in the sense that orientation or inclination thereof in the furnace is not critical. A curved, non-planar, or irregular coated surface may be fused without difficulty. Still another advantage of the invention is that various forms or shapes of flame spray coated base articles may be "ganged" or grouped for putting into the furnace since time at fusing temperature is not particularly critical as to a satisfactorily fused coating condition or result.

SUMMARY OF THE INVENTION

It is an object of the invention to provide improvements for a flame spray process for materials requiring fusion.

It is a further object of the invention to provide a series of process steps for use with a broad class or category of flame spray materials known as self-fluxing or as self-fluxing alloys.

Still further, it is an object of the invention to improve the wetting properties of flame spray materials coated on a substrate surface.

Still further, it is an object of the invention to eliminate the necessity for using a fusing technique referred to as torch fusing.

It is another and specific object of the invention to provide an improved process for fusing of flame spray materials coated on an obscure substrate surface using normal atmosphere furnace heating.

In general, after a coating of self-fluxing flame spray material has been applied onto an obscure substrate surface of a base article as by a known flame spray process, the improvement of the invention comprises the steps of: (i) applying to the coating on the surface a layer of soluble silicate solution; (ii) heating the coated surface with the layer of soluble silicate solution thereon to a temperature sufficient to form a siliceous film on the coating and to fuse the coating to the surface; and, thereafter, (iii) removing the siliceous film from the fused coating. The base article with the fused coating thereon may, if necessary, be further processed to predetermined dimensional tolerances, as by machining, grinding, polishing or honing.

DETAILED DESCRIPTION OF THE INVENTION

The invention provides an improvement for the flame spray process in which a heat-fusible self-fluxing material is heated in a heating zone to at least heat-softened condition and propelled in such condition out of said zone in finely divided form onto an obscure substrate surface of a base article or solid metal object. An obscure substrate surface is of such a dimensional character or nature or has a location relative to other dimensional features of the base article, such that a skilled operator cannot perform the fusion technique known as torch fusing.

Many prior art patents disclose and describe the conventional flame spray process which precedes the improved fusion process of the invention. Flame spray guns suitable for applying a coating to a substrate surface on a base article are disclosed in U.S. Pat. No. 2,961,335, Nov./1960, Shepard; and, U.S. Pat. No. 3,111,267, Nov./1963, Shepard et al. Obscure substrate surfaces, such as the interior of tubes, cylinders or rotary valves, which would not be accessible to a flame spray gun per se, may be reached using nozzle extensions such as disclosed in U.S. Pat. No. 3,122,321, Feb./1964, Wilson et al., or, an angular blast cap such as disclosed in U.S. Pat. No. 3,136,484, June/1964, Dittrich.

The flame spray material used to form the coating on an obscure substrate surface may be a self-fluxing boron-silicon-nickel-chromium alloy composition. The use of such a material and a suitable flame spray gun for application thereof is disclosed in U.S. Pat. No. 3,266,727, August/1966, Shepard et al., particularly Example 2. Other self-fluxing metal powders which may be used in the practice of the invention are disclosed in U.S. Pat. No. 2,936,229, May/1960, Shepard, which also describes fusing in a furnace or by means of heating torches applied directly to the coated surface.

It is further to be understood that commercially available metal powders suitable for practice of the invention include Metco powders 12C, 14E, 15E and 15F, sold by Metco, Inc., 1101 Prospect Avenue, Westbury, L.I., N.Y. 11590.

After application of the flame spray material to an obscure substrate surface, the base article per se or the substrate surface with the coating thereon is treated using an ordinary or known commercial soluble silicate solution. The soluble silicate solution may be applied by immersion of the base article in a tank of the solution or by painting the substrate surface with a brush so as to form a layer or coating to and around and over the coating of flame sprayed material. The temperature at which the soluble silicate solution is applied does not appear to be critical so long as the substrate surface is well and completely covered.

The ordinary commercial soluble silicates are prepared by melting purified silica sand with soda ash and thereafter dissolving the glass in water. The preparation of soluble silicates is further described by Vail, J. G., "Soluble Silicates," ACS Monograph No. 116, Vols. I & II, New York, Reinhold Publishing Corp., 1952.

Not all soluble silicate solutions will be suitable for practice of the invention. It is necessary to have a correct proportion of silica to alkali, which may be expressed as the empirical weight ratio of the silica to alkali content, to secure optimum results. It is to be understood that an empirical weight ratio of the silica to alkali content is not the ratio of molecular chemical compounds. For example, a solution containing 1 mole of $Na_2O$ for each 3.3 moles of $SiO_2$ will, on a weight basis, have a ratio of 3.22 percent $SiO_2$ to 1 percent $Na_2O$; thus it will be referred to as a 3.22 ratio silicate. It has been found that a soluble silicate solution suitable for practice of the invention will have a silicate weight ratio of 2.0 to 3.75. A highly alkaline sodium silicate, with a weight ratio of less than 2, will tend to crystalize before fusion of the flame spray coating to the obscure substrate surface is achieved.

The water content of a soluble silicate solution suitable for practice of the invention, expressed as a percentage of the solution, may be in the range of 42 percent to 60 percent. For reasons set forth next below, it is preferred that the water percent be in the lower value of the percent range; for example, a 3.2 weight ratio sodium silicate in a solution with a 46 percent water content.

A self-fluxing alloy coating applied by a flame spray gun to an obscure substrate surface which is curved, convex, concave or compound (that is, other than flat or substantially planar) will have both shear and tensile stresses developing at the "bond level" or interface between the substrate surface and the coating as the coating is applied. When flame spraying a self-fluxing alloy, a skilled operator should achieve a "retaining bond" adequate to retain the coating in situ on the obscure substrate surface until practice of the invention.

It is understood that a suitable soluble silicate compound may be regarded as an "inorganic adhesive" composed of colloidal electrolyte particles having a fairly high negative charge and becoming barely electro-positive as an anhydrous siliceous film is formed during heating. These colloidal characteristics also give the siliceous film the properties of deformability and development of tensile pull as the water content decreases to a relative percent of zero.

It is thought that the fusion of the flame sprayed material to the obscure substrate surface according to the invention involves at least three forces or effects contributing to the improved result of a fused coating which has not run, sagged or diffused and is in excellent condition for immediate use or for further processing to predetermined dimensional tolerances. Heating of the silicate coated metal coating will, as could be predicted, produce a thermal bond between metal coating and substrate. However, the change in polarity of the siliceous film during heating, and the development of a tensile pull within the film during heating, may also produce or result in application of a synergistic combination of molecular and mechanical bonds.

After application of the soluble silicate solution to the obscure substrate surface with the coating of flame spray material thereon, the base article is put in a normal atmosphere conventional furnace. The furnace may be heated by a suitable fuel source, electric, oil or gas, to raise the interior temperature to a range of 1900° F. to 1950° F. The atmosphere within the furnace will not be critical. The base article should be heated in the furnace until the siliceous film is formed on the coating of flame spray material and the coating is fused to the substrate surface.

After the base article having a coated surface with a layer of soluble silicate solution thereon has been heated to a temperature sufficient to form a siliceous film on the coating and to fuse the coating to the surface, the siliceous film is removed from the fused coating. Preferably, the siliceous film is removed using conventional "air blast" apparatus for the attritional application of abrasive particles at high velocity. The abrasive particles may be sand or fine steel grit.

The base articles treated according to the invention will have coated substrate surfaces featuring a permanent fused bond without run, sag or diffusion. The concepts of the invention will significantly reduce the direct labor cost in flame spraying of base articles with obscure substrate surfaces, while also permitting the development of standardized production techniques for what has heretofore been a skilled art or craft requiring a highly trained and qualified operator or technician. Therefore, while the invention has been described in detail with reference to certain specific embodiments, various changes and modifications which fall within the spirit of the invention and scope of the appended claims will become apparent to the skilled artisan. The invention is, therefore, only intended to be limited by the appended claims and their equivalents, wherein I have endeavored to claim all inherent novelty.

What is claimed is:

1. In the flame spray process in which a heat-fusible self-fluxing material is heated in a heating zone to at least heat-softened condition and propelled in said condition out of said zone in finely divided form onto an obscure substrate surface of a base article to form a coating of said material on said surface, the improvement comprising the steps of: applying to said coating on said obscure surface a layer of soluble silicate solution comprising solids with a weight ratio of the silica to alkali content of from 2.0 to 3.75; heating said coated surface with said layer of soluble silicate solution thereon to a temperature sufficient to form a siliceous film on said coating and to fuse said coating to said surface; and thereafter, removing said siliceous film from said fused coating.

2. A process according to claim 1 wherein a normal atmosphere furnace is used to heat said coated surface with said layer of soluble silicate solution thereon to a temperature in the range of from 1900° F. to 1950° F.

3. A process according to claim 1 wherein said siliceous film is removed from said fused coating by attritional application thereto of abrasive particles at high velocity.

4. A process according to claim 1 wherein the water content of said soluble silicate solution is from 42 percent to 60 percent.

* * * * *